US008962899B2

(12) United States Patent
Takagi et al.

(10) Patent No.: US 8,962,899 B2
(45) Date of Patent: Feb. 24, 2015

(54) METALWORKING LUBRICANT

(75) Inventors: Fumiaki Takagi, Ichihara (JP); Youichiro Jido, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 212 days.

(21) Appl. No.: 12/159,535

(22) PCT Filed: Dec. 26, 2006

(86) PCT No.: PCT/JP2006/325943

§ 371 (c)(1),
(2), (4) Date: Jun. 27, 2008

(87) PCT Pub. No.: WO2007/077834

PCT Pub. Date: Jul. 12, 2007

(65) Prior Publication Data

US 2010/0222618 A1 Sep. 2, 2010

(30) Foreign Application Priority Data

Dec. 28, 2005 (JP) ..... 2005-379856

(51) Int. Cl.

| | |
|---|---|
| ***C10M 127/02*** | (2006.01) |
| ***B21B 45/02*** | (2006.01) |
| ***C10M 105/04*** | (2006.01) |
| ***C10M 173/00*** | (2006.01) |

(52) U.S. Cl.

CPC ..... *C10M 105/04* (2013.01); *C10M 173/00* (2013.01); *C10M 2203/0206* (2013.01); *C10M 2203/1025* (2013.01); *C10M 2205/0285* (2013.01); *C10N 2230/00* (2013.01); *C10N 2230/04* (2013.01); *C10N 2230/06* (2013.01); *C10N 2230/64* (2013.01); *C10N 2240/40* (2013.01); *C10N 2240/401* (2013.01); *C10N 2240/402* (2013.01); *C10N 2250/02* (2013.01)

USPC ..... 585/1; 585/16; 585/510; 508/110; 508/591; 72/42

(58) Field of Classification Search

USPC ..... 585/1, 16, 18, 510–516

See application file for complete search history.

(56) References Cited

U.S. PATENT DOCUMENTS

| | | | | |
|---|---|---|---|---|
| 3,957,664 | A * | 5/1976 | Heilman et al. | 508/110 |
| 5,171,903 | A * | 12/1992 | Koyama et al. | 585/3 |
| 5,171,905 | A * | 12/1992 | Theriot et al. | 585/10 |
| 5,171,918 | A * | 12/1992 | Shubkin et al. | 585/510 |
| 5,210,346 | A * | 5/1993 | Dileo | 585/10 |
| 5,250,750 | A * | 10/1993 | Shubkin et al. | 174/17 LF |
| 5,451,704 | A * | 9/1995 | Ho et al. | 585/512 |
| 5,625,106 | A * | 4/1997 | Marks et al. | 585/512 |
| 5,817,899 | A * | 10/1998 | Hope et al. | 585/16 |
| 6,479,722 | B1 * | 11/2002 | De Wet et al. | 585/511 |
| 6,586,646 | B1 * | 7/2003 | Heilman et al. | 585/12 |
| 6,680,417 | B2 * | 1/2004 | Bagheri et al. | 585/523 |
| 6,703,356 | B1 * | 3/2004 | Wu | 508/591 |
| 8,373,011 | B2 * | 2/2013 | Sato et al. | 585/16 |
| 2008/0026967 | A1 * | 1/2008 | Suda et al. | 508/459 |
| 2008/0146469 | A1 * | 6/2008 | Sato et al. | 508/110 |
| 2009/0156874 | A1 * | 6/2009 | Patil et al. | 585/526 |
| 2009/0181872 | A1 * | 7/2009 | Yamada | 508/591 |

FOREIGN PATENT DOCUMENTS

| | | |
|---|---|---|
| JP | 51 63851 | 6/1976 |
| JP | 2 133495 | 5/1990 |
| JP | 2 269798 | 11/1990 |
| JP | 2 281097 | 11/1990 |
| JP | 6 108083 | 4/1994 |
| JP | 2001 335607 | 12/2001 |
| JP | 2005 501957 | 1/2005 |
| JP | 2005 511870 | 4/2005 |

* cited by examiner

*Primary Examiner* — Ellen McAvoy

(74) *Attorney, Agent, or Firm* — Oblon, Spivak, McClelland, Maier & Neustadt, L.L.P.

(57) ABSTRACT

Provided is a lubricant for metal working comprising a vinylidene compound having 12 to 64 carbon atoms obtained by oligomerizing α-olefins, having 4 to 20 carbon atoms, using a metallocene catalyst. The lubricant for metal working is excellent in a workability and a surface detergency property and has a high flash point and can reduce environmental pollution.

18 Claims, No Drawings

METALWORKING LUBRICANT

This application is a 371 of PCT/JP2006/325943 filed Dec. 26, 2006. Priority to Japanese patent application 2005-379856, filed Dec. 28, 2005, is claimed.

BACKGROUND OF THE INVENTION

The present invention relates to a lubricant for metal working, more specifically to a lubricant for metal working which is excellent in a workability and has a good surface detergency property and which is effective particularly for working non-ferrous metals such as aluminum, aluminum alloys and the like.

RELATED ART

Lubricants prepared by blending base oils such as mineral oils, synthetic oils and the like with oiliness agents, extreme pressure agents and the like have so far been used as lubricants for cutting and grinding working and plastic working.

However, the above conventional lubricants are unsatisfactory in workability, and addition of the oiliness agents and the extreme pressure agents described above has resulted in deteriorating a surface detergency property and rust prevention of a worked article.

A metal working lubricant containing linear olefin having 6 to 40 carbon atoms has been proposed in order to solve the above problems, and it has come to be used mainly for working of non-ferrous metals such as aluminum, copper and the like (refer to, for example, patent documents 1 to 3). This has enhanced the workability and, in addition thereto, improved the surface detergency property.

However, there has been a room of further improving the workability. Further, linear olefin has the property that when a carbon number thereof is increased, it is solidified, that is, a pour point increases higher, and therefore there have been several problems. For example, olefin having large carbon atoms is solidified at room temperature, and therefore when it is used alone, linear olefin having small carbon atoms has to be usually used. However, in metal working on severer conditions, linear olefin having small carbon atoms has a low flash point, and it is volatilized or scattered during working in a certain case. As a result, environmental pollution is likely to be brought about.

In contrast with this, when using linear olefin which has large carbon atoms and which is solidified at room temperature, it has to be used in a mixture with other mineral oils or synthetic oils in order to secure a liquidity thereof at room temperature. Accordingly, a content of linear olefin is restricted as a matter of course, and further improvement of the workability has not been achieved in a certain case.

Accordingly, required is a metal working lubricant which elevates the workability and the surface detergency property and has a high flash point and in which even a compound having relatively large carbon atoms is not solidified at room temperature.

On the other hand, poly-α-olefin (PAO) as a synthetic oil has so far been used for lubricants containing a metal working lubricant in many cases. However, conventional poly-α-olefin contains a large number of isomers even in hydrocarbon compounds having the same molecular weight, and specific components (isomers) can not be removed by a refining method such as distillation. Accordingly, a synthetic oil having a prescribed viscosity is a mixture of components with high volatility and low volatility, and when such hydrocarbon compound is used for a lubricant, the components with high volatility are volatilized first, and the viscosity of the lubricant increases larger during operation of the machine.

As the above poly-α-olefin, a compound obtained by oligomerizing α-olefin by cationic polymerization using a $BF_3$ catalyst and further hydrogenating it is used in many cases at present. In the above production process, however, a molecular weight distribution of the oligomer can not be controlled, and a large number of isomers are produced respectively even in compounds having the same polymerization degree. Accordingly, a product obtained by oligomerizing α-olefin by a $BF_3$ catalyst has the defects that refining thereof is difficult and that distillation loss is large because of a broadened boiling range of the product.

Patent document 1: Japanese Patent Application Laid-Open No. 281097/1990

Patent document 2: Japanese Patent Application Laid-Open No. 133495/1990

Patent document 3: Japanese Patent Application Laid-Open No. 269798/1990

DISCLOSURE OF THE INVENTION

In light of the situation described above, an object of the present invention is to provide a lubricant for metal working which is excellent in a workability and a surface detergency property and has a high flash point and which can reduce environmental pollution.

Intensive researches repeated by the present inventors in order to develop a lubricant for metal working having the preferred properties described above have resulted in finding that the above object can be achieved by using a vinylidene compound obtained using a metallocene catalyst. The present invention has been completed based on the above findings.

That is, the present invention provides:

1. a lubricant for metal working comprising a vinylidene compound having 12 to 64 carbon atoms obtained by oligomerizing α-olefins, having 4 to 20 carbon atoms, using a metallocene catalyst,
2. the lubricant for metal working as described in the above item 1, wherein the vinylidene compound has 12 to 56 carbon atoms,
3. the lubricant for metal working as described in the above item 1, wherein the vinylidene compound has 12 to 40 carbon atoms,
4. the lubricant for metal working as described in the above item 1, wherein the vinylidene compound has a structure represented by the general formula (I):

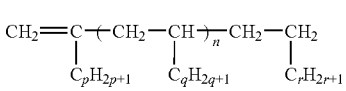

(I)

wherein p, q and r each represent independently an integer of 0 to 18; n represents an integer of 0 to 8, and when n is 2 or more, q may be the same or different in every repeating unit; and a value of p+n×(2+q)+r is 8 to 60, 5. the lubricant for metal working as described in the above item 1, comprising 5 to 100 mass % of the vinylidene compound.
6. The lubricant for metal working as described in the above item 1, comprising at least one selected from an oiliness agent, an extreme pressure agent, an antioxidant, a rust preventive, a metal deactivating agent, a detergent dispersant and a defoaming agent, 7. the lubricant for metal working as described in the above item 1, wherein the lubricant is used for working non-ferrous metals,
8. the lubricant for metal working as described in the above item 1, wherein the metal working is cutting and grinding or plastic working and
9. the lubricant for metal working as described in the above item 1, wherein the lubricant is a water-soluble lubricant blended with an emulsifier.

According to the present invention, capable of being provided is a lubricant for metal working which is excellent in a workability to various metals, non-ferrous metals of all others, particularly aluminum and aluminum alloys and excellent as well in a surface detergency property and which has a high flash point and can reduce environmental pollution.

BEST MODE FOR CARRYING OUT THE INVENTION

The vinylidene compound used in the lubricant for metal working according to the present invention is a vinylidene compound having 12 to 64 carbon atoms obtained by oligomerizing α-olefins having 4 to 20 carbon atoms using a metallocene catalyst, that is, an α-olefin oligomer. If the above vinylidene compound has carbon atoms falling in a range of 12 to 64, it endows excellent workability and surface detergency property and provides an environmental pollution prevention effect, and a lubricant for metal working prepared by using it achieves the object of the present invention. The vinylidene compound described above has carbon atoms falling in a range of preferably 12 to 56, more preferably 12 to 40 and particularly preferably 16 to 30.

Alpha(α)-olefins having 4 to 20 carbon atoms which is the raw material described above include 1-Butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene and 1-icosene. Among them, α-olefins having 8 to 16 carbon atoms are particularly preferred. The above α-olefins may be linear or branched. In the present invention, they may be used alone or in combination of two or more kinds thereof.

In the present invention, conventional catalysts, for example, include the combination of (a) a metallocene complex containing a fourth group element in the periodic table, (b) (b-1) a compound which can be reacted with the metallocene complex of the component (a) described above or a derivative thereof to form an ionic complex and/or (b-2) aluminoxane and (c) an organic aluminum compound which is used if necessary.

The metallocene complex of the component (a) containing a fourth group element in the periodic table includes a complex having a conjugated carbon five-membered ring containing titanium, zirconium or hafnium, preferably zirconium. In this regard, the complex having a conjugated carbon five-membered ring includes generally complexes having a substituted or non-substituted cyclopentadienyl ligand.

The metallocene complex of the component (a) described above includes conventional compounds, for example, bis(n-octadecylcyclopentadienyl)zirconium dichloride, bis(trimethylsilylcyclopentadienyl)zirconium dichloride, bis(tetrahydroindenyl)zirconium dichloride, bis[(t-butyldimethylsilyl)-cyclopentadienyl]zirconium dichloride, bis(di-t-butylcyclopentadienyl)zirconium dichloride, ethylidenebis(indenyl)zirconium dichloride, biscyclopentadienylzirconium dichloride, ethylidenebis(tetrahydroindenyl) zirconium dichloride, bis[3,3-(2-methyl-benzindenyl)] dimethylsilanediyl-zirconium dichloride and (1,2'-dimethylsilylene)-(2,1'-dimethylsilylene)bis(3-trimethylsilylmethylindenyl)zirconium dichloride.

The above metallocene complexes may be used alone or in combination of two or more kinds thereof.

The (b-1) compound which can be reacted with the metallocene complex or the derivative thereof to form an ionic complex includes, for example, borate compounds such as dimethylaniliniumtetrakispentafluorophenyl borate, triphenylcarbeniumtetrakispentafluorophenyl borate and the like. They may be used alone or in combination of two or more kinds thereof.

The compound (b-2) aluminoxane includes, for example, linear aluminoxanes such as methylaluminoxane, ethylaluminoxane, butylaluminoxane and isobutylaluminoxane and cyclic aluminoxanes. The above aluminoxanes may be used alone or in combination of two or more kinds thereof.

In the present invention, as the catalyst component (b), one or more kinds of the compound (b-1) described above may be used or one or more kinds of the compound (b-2) may be used, and one or more kinds of the compound (b-1) may be used in combination with one or more kinds of the compound (b-2).

When the compound (b-1) is used as the catalyst component (b), molar ratio of the catalyst component (a) to the catalyst component (b) falls in a range of preferably 10:1 to 1:100, more preferably 2:1 to 1:10. If the molar ratio is outside the range described above, the catalyst cost per a unit mass of the polymer is expensive, and it is not practical. When the compound (b-2) is used, the molar ratio falls in a range of preferably 1:1 to 1:1000000, more preferably 1:10 to 1:10000. If the molar ratio is outside the range described above, the catalyst cost per a unit mass of the polymer is expensive, and it is not practical.

The organic aluminum compound of the catalyst component (c) which is used if necessary includes, for example, trimethylaluminum, triethylaluminum, triisopropylaluminum, triisobutylaluminum, dimethylaluminum chloride, diethylaluminum chloride, methylaluminum dichloride, ethylaluminum dichloride, dimethylaluminum fluoride, diisobutylaluminum hydride, diethylaluminum hydride and ethylaluminum sesquichloride.

The above organic aluminum compounds may be used alone or in combination of two or more kinds thereof.

A molar ratio of the catalyst component (a) to the catalyst component (c) falls in a range of preferably 1:1 to 1:10000, more preferably 1:5 to 1:2000 and further more preferably 1:10 to 1:1000. Use of the above catalyst component (c) makes it possible to elevate the polymerization activity per transition metal, but too much, use of it consumes the organic aluminum compound in vain and remains in the polymer in a large amount. Accordingly, it is not preferred.

When the catalyst component (a) and (b) are used to prepare the catalyst, contact operation is carried out preferably under the atmosphere of inert gas such as nitrogen gas and the like.

When the catalyst component (a), the catalyst component (b) and the organic aluminum compound (c) are used to prepare the catalyst, the catalyst component (b) may be brought into contact in advance with the organic aluminum compound (c). The catalyst having a sufficiently high activity can be obtained as well by bringing the catalyst component (a), the catalyst component (b) and the catalyst component (c) into contact under the presence of α-olefins.

The catalyst components described above, prepared in advance in catalyst preparing baths or prepared in an oligomerization step may be used for the reaction.

An α-olefin oligomerization may be carried out by either of a batch system and a continuous system. In the oligomerization, a solvent is not necessarily required, and the oligomerization can be carried out in a suspension, a liquid monomer or an inert solvent. In the case of the oligomerization in a solvent, liquid organic hydrocarbons, for example, benzene, ethylbenzene, toluene and the like are used. The oligomerization is carried out preferably in a reaction mixture in which the liquid monomer is present in large excess.

The conditions of the oligomerization are a temperature of 15 to 100° C. and a pressure of atmospheric pressure to 0.2 MPa. A molar ratio of the catalyst to α-olefins is usually 1000 to $10^6$, preferably 2000 to $10^5$ in terms of an α-olefin/metallocene complex of the component (a), and the reaction time is usually 10 minutes to 48 hours.

In after-treatment of the oligomerization reaction, conventional deactivation treatment in which water and alcohols are added to a reaction system is first carried out to terminate the oligomerization reaction, and then deashing treatment of the catalyst is carried out by using an alkaline aqueous solution or an alcohol alkaline aqueous solution. Thereafter, washing for neutralization, distillation operation and the like are carried out, and unreacted α-olefins and olefin isomers by-produced in the oligomerization reaction are removed by stripping. Further, an α-olefin oligomer having a desired polymerization degree is isolated.

Thus, the α-olefin oligomer produced by the metallocene catalyst has a double bond and has particularly a high content of a vinylidene bond at an end.

The above α-olefin oligomer has a structure represented by the general formula (I) and having a vinylidene bond at an end:

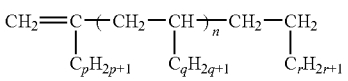

(I)

In the general formula (I) described above, p, q and r each represent independently an integer of 0 to 18; n represents an integer of 0 to 8, and when n is 2 or more, q may be the same or different in every repeating unit; and a value of p+n×(2+q)+r is 8 to 60.

The lubricant for metal working according to the present invention may contain only a vinylidene compound as far as it contains the vinylidene compound described above, but in addition thereto, it can contain other base oils and additives.

As the other base oils described above, mineral base oils and/or synthetic base oils can be used which are usually used for metal working oil.

The mineral base oils include, for example, base oils obtained by vacuum-distilling an atmospheric residue obtained by distilling a crude oil of a paraffin base, an intermediate base or a naphthene base at atmospheric pressure to obtain a lubricant fraction and refining the lubricant fraction by subjecting to at least one of solvent de-asphalting, solvent extraction, hydrocracking, solvent dewaxing and hydrorefining and base oils produced by isomerizing mineral oil waxes and waxes (gas to liquid waxes) produced by a Fisher-Tropsh process.

On the other hand, the synthetic base oils include α-olefin oligomers obtained by conventional methods ($BF_3$ catalysts, Ziegler type catalysts and the like) and hydrogenated products thereof, linear olefins having 6 to 20 carbon atoms (particularly 1-olefins having 8 to 18 carbon atoms such as 1-octene, 1-decene, 1-dodecene, 1-tetradecene, 1-hexadecene, 1-octadecene and the like), diesters such as di-2-ethylhexyl adipate and di-2-ethylhexyl sebacate, polyol esters such as trimethylolpropane caprylate and pentaerythritol 2-ethylhexanoate, aromatic synthetic oils such as alkylbenzene and alkylnaphthalene and polyalkylene glycols or mixtures thereof.

In the present invention, mineral base oils, synthetic base oils or optional mixtures of two or more kinds selected from them can be used as the other base oils. For example, at least one kind of the mineral oil base oils, at least one kind of the synthetic base oils and mixed oils of at least one kind of the mineral base oils and at least one kind of the synthetic base oils may be illustrated. The above base oils are usually blended in a range of preferably 95% by mass or less, more preferably 80% by mass or less based on the lubricant for metal working.

As the additives described above, can be suitably added is at least one selected from, for example, oiliness agents, extreme pressure agents, antioxidants, rust preventives, metal deactivating agents, detergent dispersants and defoaming agents.

The oiliness agents and the extreme pressure agents described above include preferably fatty acids, alcohols, esters, fats and oils, sulfur base extreme pressure agents, phosphoric esters such as phosphoric esters, acid phosphoric esters, phosphorous esters and acid phosphorous esters and amine salts of the above phosphoric esters.

The examples of the fatty acids, the alcohols, the esters and the fats and oils include aliphatic saturated and unsaturated monocarboxylic acids such as stearic acid and oleic acid, polymerized fatty acids such as dimer acids and hydrogenated dimer acids, hydroxyfatty acids such as ricinoleic acid and 12-hydroxystearic acid, aliphatic saturated and unsaturated monoalcohols such as lauryl alcohol and oleyl alcohol, monoesters such as butyl stearate and butyl oleate, diesters such as dimethyl azelate, polyhydric eaters such as glycerin oleate, various fats and oils such as lard, beef tallow, rape seed oil, soybean oil and rice bran oil, aliphatic saturated and unsaturated monoamines such as stearylamine and oleylamine and aliphatic saturated and unsaturated monocarboxylic amides such as lauric amide and oleic amide.

The sulfur base extreme pressure agents may be any ones as long as they have a sulfur atom in a molecule and can be evenly dissolve or dispersed in a lubricant base oil to exhibit an extreme pressure agent and an excellent frictional characteristic. The above compounds include, for example, sulfurized fats and oils, sulfurized fatty acids, sulfurized esters, sulfurized olefins, dihydrocarbyl polysulfide, thiadiazole compounds, thiophosphoric esters (thiophosphites and thiophosphates), alkylthiocarbamoyl compounds, thiocarbamate compounds, thioterpene compounds and dialkyl thiodipropionate compounds. In this regard, the sulfurized fats and oils are obtained by reacting sulfur or sulfur-containing compounds with the fats and oils described above. A sulfur content thereof shall not specifically be restricted, but the compounds having a sulfur content of usually 5 to 30% by mass are suited. Sulfurized lard, sulfurized rape seed oil, sulfurized castor oil, sulfurized soybean oil, sulfurized rice bran oil and the like can be given as the examples thereof. Sulfurized oleic acid and the like can be given as the examples of the sulfurized fatty acids, and sulfurized methyl oleate, sulfurized rice bran fatty acid octyl and the like can be given as the examples of the sulfurized esters.

The dihydrocarbyl polysulfide described above includes, for example, dibenzyl polysulfide, various dinonyl polysulfides, various didodecyl polysulfides, various dibutyl polysulfides, various dioctyl polysulfides, diphenyl polysulfide and dicyclohexyl polysulfide.

The thiadiazole compounds include, for example, 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole and 4,5-bis(1,1,3,3-tetramethylbutyldithio)-1,2,3-thiadiazole.

The thiophosphoric esters include alkyltrithiophosphite, aryl- or alkylarylthiophosphate and zinc dialkyldithiophosphate.

The alkylthiocarbamoyl compounds include, for example, bis(dimethylthiocarbamoyl) monosulfide, bis(dibutylthiocarbamoyl) monosulfide, bis(dimethylthiocarbamoyl) disulfide, bis(dibutylthiocarbamoyl) disulfide, bis(diamylthiocarbamoyl) disulfide and bis(dioctylthiocarbamoyl) disulfide.

Further, zinc dialkyldithiocarbamate can be given as the example of the thiocarbamate compound; a reaction product of phosphorus pentasulfide with pinene can be given as the example of the thioterpene compound; and dilauryl thiodipropionate and distearyl thiodipropionate can be given as the example of the dialkyl thiodipropionate compound.

The phosphoric ester includes, for example, triaryl phosphate, trialkyl phosphate, trialkylaryl phosphate, triarylalkyl phosphate and trialkenyl phosphate, and capable of being given are, for example, triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, di(ethylphenyl)phenyl phosphate, propylphenyldiphenyl phosphate, di(propylphenyl)phenyl phosphate, triethylphenyl phosphate, tripropylphenyl phosphate, butylphenyldiphenyl phosphate, di(butylphenyl)phenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate and trioleyl phosphate.

The acid phosphoric esters include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate and isostearyl acid phosphate.

The phosphorous esters include, for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite and trioleyl phosphite.

The acid phosphorous esters include, for example, dibutyl hydrogenphosphite, dilauryl hydrogenphosphite, dioleyl hydrogenphosphite, distearyl hydrogenphosphite and diphenyl hydrogenphosphite. Among the above phosphoric esters, tricresyl phosphate and triphenyl phosphate are suited.

Amines forming amine salts with the above phosphoric esters include monosubstituted amines such as butylamine, pentylamine, hexylamine, cyclohexylamine, octylamine, laurylamine, stearylamine, oleylamine and benzylamine, disubstituted amines such as dibutylamine, dipentylamine, dihexylamine, dicyclohexylamine, dioctylamine, dilaurylamine, distearylamine, dioleylamine, dibenzylamine, stearyl•monoethanolamine, decyl•monoethanolamine, hexyl•monopropanolamine, benzyl•monoethanolamine, phenyl•monoethanolamine and tolyl•monopropanolamine and trisubstituted amines such as tributylamine, tripentylamine, trihexylamine, tricyclohexylamine, trioctylamine, trilaurylamine, tristearylamine, trioleylamine, tribenzylamine, dioleyl•monoethanolamine, dilauryl•monopropanolamine, dioctyl•monoethanolamine, dihexyl•monopropanolamine, dibutyl•monopropanolamine, oleyl•diethanolamine, stearyl•dipropanolamine, lauryl•diethanolamine, octyl•dipropanolamine, butyl•diethanolamine, benzyl•diethanolamine, phenyl•diethanolamine, tolyl•dipropanolamine, xylyl•diethanolamine, triethanolamine and tripropanolamine.

The above oiliness agents and extreme pressure agents may be used alone or in combination of two or more kinds thereof. A blend amount thereof is selected in a range of usually 0.01 to 30% by mass, preferably 0.05 to 10% by mass based on the whole amount of the lubricant for metal working in terms of balance between the effect and the economical efficiency.

The examples of the antioxidant include amine base antioxidants, phenol base antioxidants and sulfur base antioxidants.

The amine base antioxidants include, for example, monoalkyldiphenylamines such as monooctyldiphenylamine and mononononyldiphenylamine, dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine, polyalkyldiphenylamines such as tetrabutyldiphenylamine, tetrahexyldiphenylamine, tetraoctyldiphenylamine and tetranonyldiphenylamine and naphthylamines such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Among them, dialkyldiphenylamines are preferred.

The phenol base antioxidants include, for example, monophenols such as 2,6-di-tert-butyl-4-methylphenol and 2,6-di-tert-butyl-4-ethylphenol and diphenols such as 4,4'-methylenebis(2,-6-di-tert-butylphenol) and 2,2'-methylenebis(4-ethyl-6-tert-butylphenol).

The sulfur base antioxidants include, for example, phenothiazine, pentaerythritol-tetrakis-(3-laurylthiopropionate), bis(3,5-tert-butyl-4-hydroxybenzyl) sulfide, thiodiethylenebis(3-(3,5-di-tert-butyl-4-hydroxyphenyl) propionate and 2,6-di-tert-butyl-4-(4,6-bis(octylthio)-1,3,5-triazine-2-methylamino)phenol.

The above antioxidants may be used alone or in combination of two or more kinds thereof. A blend amount thereof is selected in a range of usually 0.01 to 10% by mass, preferably 0.03 to 5% by mass based on the whole amount of the lubricant for metal working.

The rust preventive include, for example, alkyl- or alkenylsuccinic acid derivatives such as dodecenylsuccinic half esters, octadecenylsuccinic anhydride and dodecenylsuccinic amide, polyhydric alcohol partial esters such as sorbitan monooleate, glycerin monooleate and pentaerythritol monooleate, amines such as rosin amines and N-oleylsarcosine and dialkylphosphite amine salts. They may be used alone or in combination of two or more kinds thereof.

A blend amount of the above rust preventives falls in a range of preferably 0.01 to 5% by mass, particularly preferably 0.05 to 2% by mass based on the whole amount of the lubricant.

Compounds of, for example, a benzotriazole base, a thiadiazole base and a gallic ester base can be used as the metal deactivating agent.

A blend amount of the above metal deactivating agents falls in a range of preferably 0.01 to 0.4% by mass, particularly preferably 0.01 to 0.2% by mass based on the whole amount of the lubricant for metal working.

The detergent dispersant includes metal base detergent such as alkaline earth metal sulfonates, phenates, salicylates and phosphonates of a neutral or over base number and ashless dispersants such as alkenylsuccinic amides, benzylamine, alkylpolyamine and alkenylsuccinic esters. The above detergent dispersants may be used alone or in combination of two or more kinds thereof. A blend amount thereof is usually 0.1 to 30% by mass, preferably 0.5 to 10% by mass based on the whole amount of the lubricant for metal working.

The example of the defoaming agent is suitably liquid silicone, and methyl silicone, fluorosilicone and polyacrylate can be used.

A preferred blend amount of the above defoaming agents is 0.0005 to 0.01% by mass based on the whole amount of the lubricant for metal working.

The form of the lubricant for metal working according to the present invention may be a so-called water-soluble lubricant (a formulated concentrate of a water-soluble metal working lubricant) prepared by blending an emulsifier and, if necessary, water with the vinylidene compound described above or an lubricant prepared by adding other base oils and additives to the vinylidene compound. The above formulated concentrate of the water-soluble lubricant for metal working is further diluted to 5 to 500 times with water and used in the form of an lubricant in which the lubricant is dispersed in water to form an emulsion.

The emulsifier described above shall not specifically be restricted, and anionic emulsifiers, cationic emulsifiers, nonionic emulsifiers and amphoteric emulsifiers can be used. Also, these emulsifiers can be used in a mixture. The suited examples thereof include, for example, the anionic emulsifiers, the nonionic emulsifiers or the mixtures thereof.

The anionic emulsifiers described above include salts of carboxylic acids (for example, saturated or unsaturated fatty acids having 7 to 22 carbon atoms, hydroxyfatty acids and the like) or suit of sulfonic acid with amines or metals, esters of polycondensation products of hydroxyfatty acids such as ricinolic acid and the like with fatty acids or salts thereof with amines or metals, sulfuric ester salts such as sodium dialkylsulfosuccinate and the like, phosphoric ester salts, polymerization type high molecular emulsifiers obtained by partially saponifying copolymers of olefins such as styrene and the like with maleic anhydride and naphthalenesulfonic acid-formalin condensation type high molecular emulsifiers.

The nonionic emulsifiers include, for example, polyoxyalkylene base emulsifiers such as polyoxyalkylene glycol or mono- or diether compounds thereof, glycerin or alkylene oxide adducts thereof or ether compounds thereof, esters of carboxylic acids with alcohols, amides of alkanolamines with fatty acids or carboxylic acids and alkylene oxide adducts of alkylamines.

A blend amount of the above emulsifiers is usually 10 to 80% by mass based on the lubricant (formulated concentrate) before diluted.

A kinematic viscosity of the lubricant (containing a formulated concentrate of a water-soluble lubricant) for metal working according to the present invention shall not specifically be restricted, and usually the kinematic viscosity at 40° C. is preferably 1 to 300 $mm^2/s$, more preferably 2 to 200 $mm^2/s$ and further more preferably 3 to 100 $mm^2/s$. If the kinematic viscosity at 40° C. is 1 $mm^2/s$ or more, the working performance is good, and if it is 300 $mm^2/s$ or less, the lubricant is smoothly supplied to a worked part.

A lubricating method by the lubricant for metal working according to the present invention shall not specifically be restricted, and it can effectively be used for all lubricating method. That is, the lubricant for metal working according to the present invention can effectively be used not only for a conventional lubricating method in which the lubricant for metal working or the water-soluble lubricant for metal working is supplied directly to a worked part but also for an oil mist lubricating method in which the lubricant for metal working is supplied to a worked part in the form of an oil mist.

EXAMPLES

Next, the present invention shall be explained in further details with reference to examples, but the present invention shall by no means be restricted by these examples.

The properties and the performances of lubricants for metal working obtained in the respective examples were determined by methods shown below.

(1) Flash Point

Measured by a C.O.C. method based on JIS K2265.

(2) Pour Point

Measured based on JIS K2269.

(3) Frictional Coefficient

A friction part was slid on the following conditions by means of a reciprocating dynamic friction testing equipment to carry out a friction experiment, whereby a frictional coefficient in final sliding was measured.

Test ball: diameter ½ inch, material SUJ-2

Test board (material): A1050P

Load: 9.8 N (1 kgf)

Sliding speed: 10 mm/s

Sliding distance: 20 mm

Sliding frequency: 20 times

Experiment temperature: 30° C.

Amount of oil applied: 0.5 ml (4) Tap Working Experiment

Rolling tap working was carried out on the following conditions by means of a vertical type machining center to measure a tap torque in working. It is shown that the smaller the torque is, the more excellent the workability is.

Tool: M10×P1.5

Working speed: 20 m/min.

Working depth: 25 mm

Material to be machined: A6061 (prepared hole: ϕ9.3 mm, depth: 30 mm)

(5) Emulsification Experiment

A water-soluble metal working lubricant (formulated concentrate) was diluted to a 5% solution with water (distilled water), and the emulsification state was observed and evaluated from the appearance after 24 hours.

Examples 1 to 3 and Comparative Examples 1 to 4

Base oils and additives shown in Table 1 were used and mixed in proportions shown in Table 1 to prepare lubricants for metal working, and the properties and the performances thereof were determined. The results thereof are shown in Table 1.

TABLE 1

| | | Example | | | Comparative Example | | | |
|---|---|---|---|---|---|---|---|---|
| | | 1 | 2 | 3 | 1 | 2 | 3 | 4 |
| Blend proportion (% by mass) of oil solution | Vinylidene compound-1[1)] | 100 | 50 | 30 | | | | |
| | Mineral oil[2)] | | 50 | 70 | 100 | | | |
| | PAO[3)] | | | | | 100 | | |
| | Linear olefin-1[4)] | | | | | | 100 | |
| | Linear olefin-2[5)] | | | | | | | 100 |
| | Content of vinylidene compound in base oil | (100) | (50) | (30) | (0) | (0) | (0) | (0) |
| Property & performance | Pour point (° C.) | −15 | — | — | −40> | −40> | −12.5 | 2.5 |
| | Frictional coefficient | 0.118 | 0.118 | 0.120 | 0.140 | 0.260 | 0.128 | 0.124 |
| | Flash point (° C.) | 186 | — | — | 150 | 156 | 122 | 144 |
| | Torque (N · m) in tap working | 6.8 | 6.9 | 7.1 | 8.9 | 9.8 | 7.4 | 7.3 |

Remarks:

[1)]1-Decene dimer (manufactured using a metallocene catalyst), kinematic viscosity at 40° C. = 4.47 $mm^2/s$, pour point = −15.0° C., flash point = 186° C., molecular weight = 280

[2)]Naphthene base mineral oil, kinematic viscosity at 40° C. = 9.5 $mm^2/s$, pour point = −40° C. or lower, flash point = 150° C.

[3)]Hydrogenated product of an α-olefin oligomer which is an oligomer of 1-decene prepared by a conventional method (trade name: DURASYN-162, manufactured by BP Chemicals, Ltd.), kinematic viscosity at 40° C. = 5.1 $mm^2/s$, pour point = −40° C. or lower

[4)]1-Tetradecene, kinematic viscosity at 40° C. = 1.85 $mm^2/s$, pour point = −12.5° C., flash point = 122° C., molecular weight = 196

[5)]1-Hexadecene, kinematic viscosity at 40° C. = 2.61 $mm^2/s$, pour point = 2.5° C., flash point = 144° C., molecular weight = 224

It can be found from the results summarized in Table 1 that the lubricants prepared in Examples 1 to 3 containing the vinylidene compound according to the present invention have a lower frictional coefficient and a smaller working torque in tap working than those of the lubricants prepared in Comparative Examples 1 to 4 containing no vinylidene compound. Further, it can be found that the lubricant (kinematic viscosity at 40° C. is 4.47 $mm^2/s$) prepared in Example 1 has a lower pour point and a higher flash point than those of the lubricants prepared in Comparative Examples 3 and 4 comprising linear olefins having lower viscosities (kinematic viscosities at 40° C. are 1.85 $mm^2/s$ and 2.61 $mm^2/s$).

Example 4 and Comparative Examples 5 to 8

Base oils and additives shown in Table 2 were used and mixed in proportions shown in Table 2 to prepare water-soluble metal working lubricants (formulated concentrates), and the properties and the performances thereof were determined. The results thereof are shown in Table 2.

It can be found from the results summarized in Table 2 that a 5% diluted solution of the water-soluble lubricant for metal working prepared in Example 4 containing the vinylidene compound according to the present invention has a lower frictional coefficient and a smaller working torque in tap working than those of 5% diluted solutions of the water-soluble lubricants for metal working prepared in Comparative Examples 5 to 8 containing no vinylidene compound. Further, it can be found that the water-soluble lubricant prepared in Example 1 containing the vinylidene compound having a high kinematic viscosity at 40° C. has a lower pour point than those of the water-soluble lubricants (formulated concentrates) prepared in Comparative Examples 7 and 8 containing linear olefins having lower viscosities.

Industrial Applicability

The lubricant for metal working according to the present invention is a lubricant for metal working which is excellent in a workability to various metals, non-ferrous metals of all others, particularly aluminum and aluminum alloys and is

TABLE 2

| | | | Example | Comparative Example | | | |
|---|---|---|---|---|---|---|---|
| | | | 4 | 5 | 6 | 7 | 8 |
| Blend proportion (% by mass) of oil solution | Base oil | Vinylidene compound-1[1)] | 54 | | | | |
| | | Mineral oil[2)] | | 54 | | | |
| | | PAO[3)] | | | 54 | | |
| | | Linear olefin-1[4)] | | | | 54 | |
| | | Linear olefin-2[5)] | | | | | 54 |
| | | Content of vinylidene compound in base oil | (100) | (0) | (0) | (0) | (0) |
| | Additive[6)] for water-soluble working lubricant | | 36 | 36 | 36 | 36 | 36 |
| | Water (distilled water) | | 10 | 10 | 10 | 10 | 10 |
| Property & performance | Pour point (° C.) | | −25.0 | −40> | −40> | −15.0 | 0.0 |
| | Frictional coefficient (5% diluted solution) | | 0.094 | 0.130 | 0.132 | 0.140 | 0.108 |
| | Torque (5% diluted solution) (N · m) in tap working | | 6.0 | 7.2 | 8.1 | 6.5 | 6.5 |
| | Emulsification state (5% diluted solution) | | Good | Good | Good | Good | Good |

Remarks:

[1)]to [5)]same as in Table 1

[6)]mixture of tall oil fatty acid (42% by mass) dicyclohexylamine (19% by mass), diethanolamine (11% by mass), polyoxyethylene oleyl ether (11% by mass), lanoline (11% by mass), dodecanedicarboxylic acid (3% by mass) and benzotriazole (3% by mass)

excellent as well in a surface detergency property and which has a high flash point and can reduce environmental pollution. Accordingly, it can effectively be used as a lubricant for working various metals, non-ferrous metals of all others, particularly aluminum and aluminum alloys.

What is claimed is:

1. A method of metal working comprising working a metal in the presence of a lubricant comprising:

5 to 50% by mass of a vinylidene compound relative to 100 mass % of the lubricant, and a base oil, wherein said vinylidene compound is 1-Decene dimer manufactured in the presence of a metallocene catalyst, and wherein the metal working comprises cutting, grinding, or plastic working.

2. The method of claim 1, wherein the lubricant further comprises at least one additive selected from the group consisting of an oiliness agent, an extreme pressure agent, an antioxidant, a rust preventive, a metal deactivating agent, a detergent dispersant and a defoaming agent.

3. The method of claim 1, wherein the lubricant further comprises an emulsifier.

4. The method of claim 1, wherein the metal is non-ferrous.

5. The method of claim 1, wherein the metal is aluminum or an alloy of aluminum.

6. The method of claim 1, wherein the metallocene catalyst comprises:

(a) a metallocene complex comprising a fourth group element in the periodic table, (b-1) a compound which reacts with the metallocene complex to form an ionic complex and/or (b-2) aluminoxane, and (c) optionally an organic aluminum compound.

7. The method of claim 6, wherein the metallocene complex comprises a conjugated carbon five-membered ring comprising titanium, zirconium or hafnium.

8. The method of claim 7, wherein the metallocene complex having a conjugated carbon five-membered ring comprises a substituted or non-substituted cyclopentadienyl.

9. The method of claim 6, wherein the metallocene complex is selected from the group consisting of bis(n-octadecylcyclopentadienyl)zirconium dichloride, bis(trimethylsilylcyclopentadienyl)zirconium dichloride, bis(tetrahydroindenyl) zirconium dichloride, bis[(t-butyldimethylsilyl)-cyclopentadienyl]zirconium dichloride, bis(di-t-butylcyclopentadienyl)zirconium dichloride, ethylidenebis (indenyl)zirconium dichloride, biscyclopentadienylzirconium dichloride, ethylidenebis(tetrahydroindenyl)zirconium dichloride, bis[3,3-(2-methylbenzindeny)]dimethylsilanediyl-zirconium dichloride and (1,2' -dimethylsilylene)-(2,1'-dimethylsilylene)bis(3-trimethylsilylmethylindenyl)zirconium dichloride.

10. The method of claim 6, wherein said catalyst comprises (b-1) the compound which reacts with the metallocene complex to form an ionic complex, and wherein (b-1) is a borate compound.

11. The method of claim 6, wherein said catalyst comprises (b-2) the aluminoxane, and wherein (b-2) is a cyclic aluminoxane or a linear aluminoxane.

12. The method of claim 1, wherein the lubricant comprises 5 to 30% by mass of said vinylidene compound relative to 100 mass % of the lubricant.

13. The method of claim 1, wherein the lubricant further comprises water.

14. The method of claim 1, wherein said base oil is a mineral base oil.

15. The method of claim 1, wherein said base oil is a synthetic base oil.

16. The method of claim 1, wherein the metal working comprises cutting.

17. The method of claim 1, wherein the metal working comprises grinding.

18. The method of claim 1, wherein the metal working comprises plastic working.

* * * * *